US008692120B2

(12) United States Patent
Debladis et al.

(10) Patent No.: US 8,692,120 B2
(45) Date of Patent: Apr. 8, 2014

(54) ELECTRICAL CONTROL CABLE

(75) Inventors: Francis Debladis, Sainte Catherine les Arras (FR); Laurent Tribut, Lyons (FR); Stéphane Morice, Leforest (FR)

(73) Assignee: Nexans, Paris (FR)

( * ) Notice: Subject to any disclaimer, the term of this patent is extended or adjusted under 35 U.S.C. 154(b) by 614 days.

(21) Appl. No.: 12/217,906

(22) Filed: Jul. 9, 2008

(65) Prior Publication Data

US 2009/0071688 A1 Mar. 19, 2009

(30) Foreign Application Priority Data

Jul. 20, 2007 (FR) ..... 07 56639

(51) Int. Cl.
*H01B 5/10* (2006.01)

(52) U.S. Cl.
USPC ..... 174/131 A; 174/128.2

(58) Field of Classification Search
USPC ..... 174/113 C, 131 A, 128.2; 57/237
See application file for complete search history.

(56) References Cited

U.S. PATENT DOCUMENTS

| | | | | |
|---|---|---|---|---|
| 2,971,321 | A * | 2/1961 | Himmelfarb et al. | 57/237 |
| 3,137,990 | A * | 6/1964 | Carranza | 57/242 |
| 3,980,808 | A * | 9/1976 | Kikuchi et al. | 174/110 SR |
| 4,449,012 | A * | 5/1984 | Voser | 174/70 A |
| 5,122,622 | A * | 6/1992 | Reuss et al. | 174/113 C |
| 5,159,157 | A | 10/1992 | Diegmann | 174/113 |
| 7,145,082 | B2 | 12/2006 | Hochleithner et al. | 174/113 |

FOREIGN PATENT DOCUMENTS

| | | | |
|---|---|---|---|
| DE | 4136227 | 5/1993 | H01B 7/00 |
| DE | 10016536 | * 10/2001 | |
| EP | 1089299 | 4/2001 | H01B 7/18 |
| WO | 03091008 | 11/2003 | |

OTHER PUBLICATIONS

French International Search Report dated Jan. 31, 2008.

* cited by examiner

*Primary Examiner* — Chau Nguyen
(74) *Attorney, Agent, or Firm* — Sofer & Haroun, LLP

(57) ABSTRACT

The present invention relates to an electrical control cable of the type comprising a core having a plurality of polymer filaments, a plurality of strands of conductor material extending in the longitudinal direction of said core, an outer insulating sheath. According to the invention, said strands are distributed uniformly and concentrically over the periphery of said core, in contact with one another in pairs and in contact with said core, and the filaments of said core are secured to one another to form a non-metallic unitary structure that is obtained by organizing said filaments into a plurality of subassemblies, the filaments in any one subassembly being twisted together helically, the subassemblies in turn being twisted with one another to form an overall helix. Advantage: the cable uses a limited number of copper strands while guaranteeing that crimping operations are reliable.

6 Claims, 2 Drawing Sheets

ELECTRICAL CONTROL CABLE

RELATED APPLICATION

This application claims the benefit of priority from French Patent Application No. 07 56639, filed on Jul. 20, 2007, the entirety of which is incorporated by reference.

FIELD OF THE INVENTION

The present invention relates to electrical control cables, or power cables, used for delivering electricity.

BACKGROUND OF THE INVENTION

Such cables are used in various fields in industry, such as, for example, the automobile industry, where they are assembled in bundles for electrically powering various pieces of equipment. Such cables thus need to be as lightweight as possible, and to be compact, while retaining good mechanical strength.

Conventionally, such cables are made up of a plurality of copper strands, generally twisted together to form a twisted strand so as to increase the flexibility of the cable, and surrounded by an insulating sheath, e.g. obtained by extrusion. FIG. 1 shows an example of such a cable 1, seen in cross-section, and made from seven identical copper strands 20 surrounded by an insulating sheath 30 of circular section. To give a concrete idea, the diameter of the cable is typically about 1.6 millimeters (mm) and each of the copper strands 20 presents a diameter of about 0.3 mm.

Other cables of structure similar to that of FIG. 1, but having some other number of copper strands, e.g. nineteen strands, are also known.

The advantages of a cable having the same structure lie essentially in the simplicity of its method of fabrication, and also in the fact that it is suitable for crimping reliably to connectors. It suffices to strip the cable locally by removing a portion of the insulating sheath 30 where it is desired to place a connector, and then to compress the bushing of the connector mechanically around the stripped section of cable. In addition, copper intrinsically presents good mechanical strength in traction.

In contrast, it has been found that the above cable makes use of a quantity of copper that is excessive compared with the real requirements corresponding to the amount of electricity that is to be conveyed by the cable. More precisely, about half of the copper in the above cable structure is used for providing the cable with traction strength, and also for guaranteeing effective crimping.

Unfortunately, copper is becoming ever more expensive, and it is important to find new cable structures that minimize the quantity of copper used to the smallest possible amount.

Various composite cable solutions are already known in which copper strands are combined with a core of non-conductive material. In particular, U.S. Pat. No. 7,145,082 describes a control cable in which a large quantity of conductor wires, e.g. made of copper, are twisted around a central core made up of a multistrand polymer of the aramid fiber type.

That type of cable makes it possible to reduce significantly the quantity of copper that is used, down to the amount that is just sufficient for good signal transmission, while conserving very good mechanical strength in traction because of the use of the aramid. In contrast, the number of copper strands remains very large compared with the solution shown in FIG. 1 where the copper strands are disposed in a single concentric layer around the central strand.

Merely replacing the central copper strand in the structure of FIG. 1 with a multifilament polymer core of the kind described in U.S. Pat. No. 7,145,082 is not appropriate since such a cable does not provide sufficient guarantees concerning crimping operations. Once such a cable is stripped for a crimping operation, the copper strands splay apart from one another a little, and some of the polymer filaments making up the core run the risk of escaping radially between two copper strands. This situation is shown diagrammatically in FIG. 2 which is a cross-section of such a cable after a portion of the insulating sheath 20 has been stripped. As can be seen, certain filaments of the core 40 made of multifilament polymer are to be found on the outside of the outer ring of copper strands 20. Thus, when the bushing of the connector is compressed around the stripped section of cable, these filaments become interposed between the copper strands and the bushing, thereby reducing the contact area relative to that required for proper transmission of the electrical signal.

Patent document EP 1 089 299 discloses a cable structure in which a plurality of strands of conductive material are twisted concentrically around a core made up of a plurality of reinforcing fibers embedded in a metal material. Such a cable is expensive to fabricate, in particular because it uses a matrix of metal material for embedding the fibers.

U.S. Pat. No. 5,159,157 also discloses a control cable in accordance with the preamble of claim 1 of the present application, in which the carbon fibers of the core are secured to a non-metallic unitary structure. More precisely, a vaseline type filler matrix fills all of the cavities between the carbon fibers and the strands of conductive material. Such a structure remains expensive to fabricate, because it uses said filler matrix.

OBJECTS AND SUMMARY OF THE INVENTION

An object of the present invention is to provide a cable using just sufficient conductive material, typically copper, to ensure signal transmission, said material being shared amongst a limited number of strands, while also guaranteeing reliable crimping of a connector, and being as inexpensive as possible to fabricate.

According to the invention, this object is achieved by an electrical control cable of the type comprising:

- a core made up of a plurality of polymer filaments;
- a plurality of strands of conductor material extending in the longitudinal direction of said core, distributed uniformly and concentrically around the periphery of said core, in contact in pairs with each other and in contact with said core; and
- an outer insulating sheath;

wherein said filaments are distributed as a plurality of subassemblies, the filaments of a given subassembly being twisted together helically, the subassemblies also being twisted to one another in order to form an overall helix.

BRIEF DESCRIPTION OF THE DRAWINGS

The invention and the advantages it provides can be better understood in the light to the following description made with reference to the accompanying figures, in which:

FIG. 3 shows a portion of a cable 1 constituting a first possible embodiment, having its end stripped to show the internal structure of the cable.

MORE DETAILED DESCRIPTION

Figure 1:
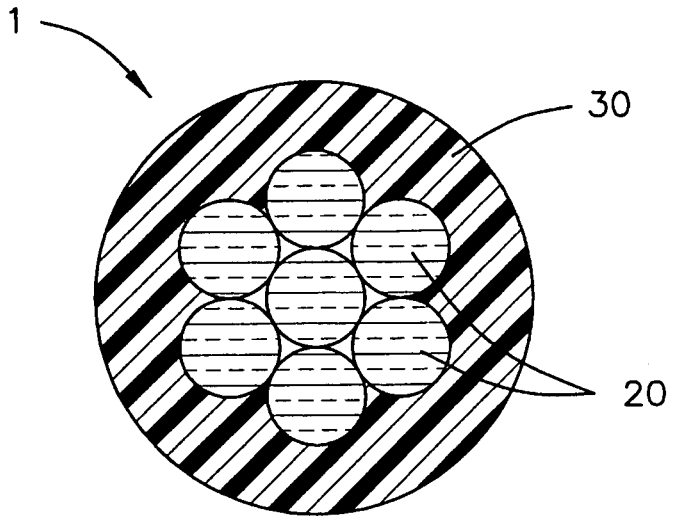
FIG. 1 (PRIOR ART)
FIG. 1, described above, is a cross-section of a cable having seven strands of copper and known in the prior art.
Figure 2:
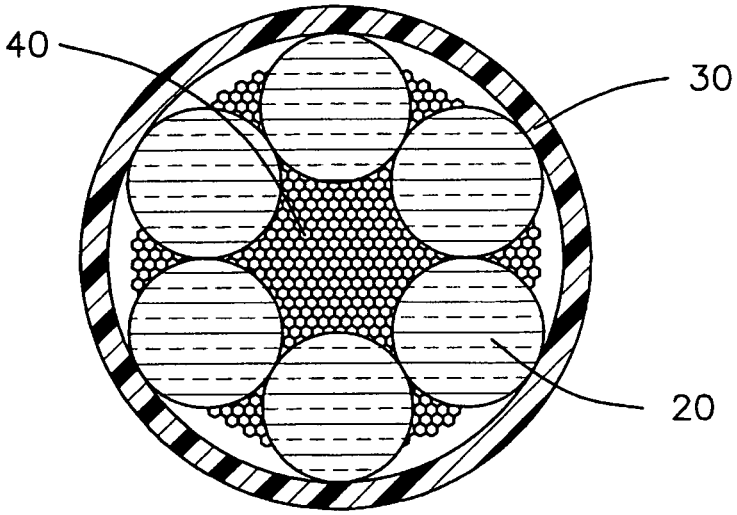
FIG. 2, described above, is a cross-section showing a stripped cable in which the central copper strand has been replaced by a multifilament polymer core.
Figure 3:
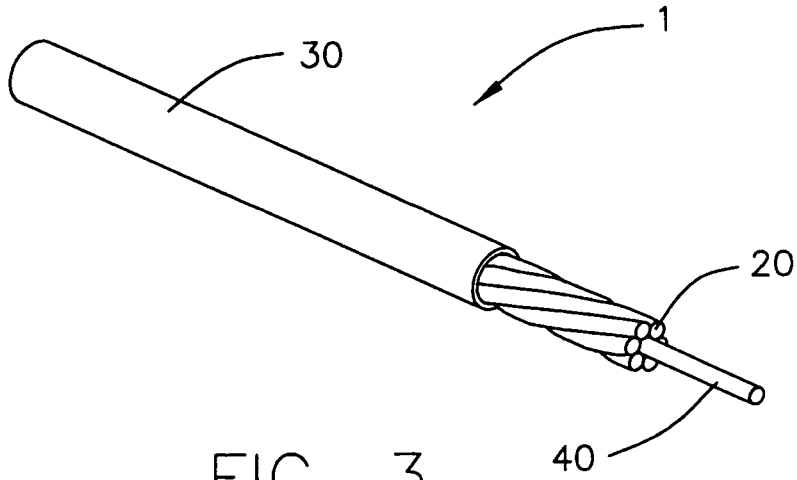
FIG. 3 shows the structure of a cable in one possible embodiment.

Like the prior art cable described in U.S. Pat. No. 7,145,082, the cable 1 of FIG. 3 comprises a plurality of strands 20 of conductive material, e.g. copper, extending in the longitudinal direction of a central core 40 of multifilament polymer, together with an outer sheath 30 of insulating material.

However, the number of strands 20 used is reduced since these strands are distributed uniformly and concentrically around said core 40, being in contact with one another in pairs and also with said core. In the non-limiting example shown, these strands 20 are six in number. For other sections of the core and of the strands, the total number of copper strands must naturally be adapted to surround the periphery of the core in a single layer.

The polymer filaments of the core 40, e.g. made of aramid, are secured to one another to constitute a non-metallic unitary structure, merely by means of an external adhesive coating. Such a step in the fabrication method is very easy to perform and therefore does not significantly increase the total fabrication cost of the cable. In addition, by removing a portion of the sheath 30 for the operation of crimping a connector, there is no risk of the filaments of the core 40 becoming interposed between the strands 20 and the connector, even if the strands 20 do splay apart a little.

In another variant embodiment (not shown), the non-metallic structure is secured by twisting the filaments helically and by covering the helix in a matrix or a sheath of non-metallic material. The fabrication method is a little more complex than when merely applying an adhesive coating, but it nevertheless makes use of techniques that are well known for helically winding a plurality of yarns followed by sheathing, e.g. by extrusion.

Figure 4:
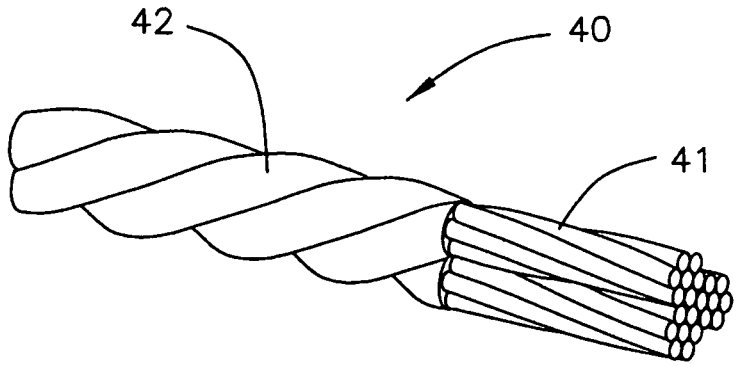
FIG. 4 shows the non-metallic unitary structure of a core for a cable in a preferred embodiment of the invention.

FIG. 4 shows a non-metallic unitary structure 40 in the preferred embodiment of the invention. The core filaments are organized as a plurality of subassemblies (three subassemblies in the non-limiting example shown in FIG. 4). Each subassembly is made up of a plurality of filaments 41, preferably seven filaments, that are twisted together helically and placed inside a sheath 42 of insulating material. The three subassemblies as obtained in this way are then twisted with one another so as to form an overall helix. In preferred manner, and as shown in FIG. 4, the subassemblies are twisted together to constitute an overall helix of pitch that is opposite relative to the pitches of the helices constituting each of the subgroups. This further reduces any risk of some of the filaments managing to escape during a connector-crimping operation. Instead of using the sheath 42, each subassembly could be embedded in a matrix of non-metallic material prior to forming the overall helix. In another variant, each subassembly could be coated in adhesive.

In all of the embodiments, the polymer of the core may be aramid, or high performance polyester, or polyamide, or polyester naphthalate.

What is claimed is:

1. An electrical control cable of the type comprising:

a core made up of a plurality of polymer filaments;

a plurality of strands of conductor material extending in the longitudinal direction of said core, distributed uniformly and concentrically around the periphery of said core, in contact in pairs with each other and in contact with said core; and an outer insulating sheath in contact with each strand, wherein said filaments are distributed as a plurality of subassemblies, the filaments of each subassembly being twisted together helically, each subassembly being embedded in a matrix of non metallic material, the subassemblies also being twisted to one another in an overall helix of a pitch and arrangement such that said filaments are prevented from radially escaping between said strands when said strands are splayed apart during a crimping operation involving stripping a portion of said outer insulating sheath.

2. A control cable according to claim 1, wherein the overall helical pitch of the twisted-together subassemblies is opposite to the helical pitches of each of the subassemblies.

3. A control cable according to claim 1, wherein the conductor material is copper.

4. A control cable according to claim 1, wherein the polymer of the core is aramid, or high performance polyester, or polyamide, or polyester naphthalate.

5. An electrical control cable of the type comprising:

a core made up of a plurality of polymer filaments;

plurality of strands of conductor material extending in the longitudinal direction of said core, distributed uniformly and concentrically around the periphery of said core, in contact in pairs with each other and in contact with said core; and an outer insulating sheath in contact with each strand, wherein said filaments are distributed as a plurality of subassemblies, the filaments of each subassembly being twisted together helically, each subassembly being coated in adhesive, the subassemblies also being twisted to one another in an overall helix of a pitch and arrangement such that said filaments are prevented from radially escaping between said strands when said strands are splayed apart during a crimping operation involving stripping a portion of said outer insulating sheath.

6. An electrical control cable of the type comprising:

a core made up of a plurality of polymer filaments;

a plurality of strands of conductor material extending in the longitudinal direction of said core, distributed uniformly and concentrically around the periphery of said core, in contact in pairs with each other and in contact with said core; and an outer insulating sheath in contact with each strand, wherein said filaments are distributed as a plurality of subassemblies, the filaments of each subassembly being twisted together helically, each subassembly being covered by a sheath of non metallic material, the subassemblies also being twisted to one another in an overall helix such that said filaments are prevented from radially escaping between said strands when said strands are splayed apart during a crimping operation involving stripping a portion of said outer insulating sheath.

* * * * *